US007820915B2

(12) United States Patent
Goto et al.

(10) Patent No.: US 7,820,915 B2
(45) Date of Patent: Oct. 26, 2010

(54) TINSEL WIRE

(75) Inventors: Yoshihide Goto, Yamagata (JP); Masashi Oyanagi, Yamagata (JP); Taiki Goto, Yamagata (JP); Naoto Takahashi, Yamagata (JP)

(73) Assignee: GOTO Electronic Co., Ltd., Sagae-shi (JP)

( * ) Notice: Subject to any disclaimer, the term of this patent is extended or adjusted under 35 U.S.C. 154(b) by 110 days.

(21) Appl. No.: 12/245,896

(22) Filed: Oct. 6, 2008

(65) Prior Publication Data

US 2009/0250242 A1 Oct. 8, 2009

(30) Foreign Application Priority Data

Apr. 8, 2008 (JP) ..... 2008-100060
Jul. 31, 2008 (JP) ..... 2008-197755

(51) Int. Cl.
*H01B 7/00* (2006.01)

(52) U.S. Cl. ..... 174/113 C; 174/115

(58) Field of Classification Search ..... 174/113 R, 174/113 C, 115

See application file for complete search history.

(56) References Cited

U.S. PATENT DOCUMENTS 5,516,986 A * 5/1996 Peterson et al. ..... 174/113 C

FOREIGN PATENT DOCUMENTS

JP 2004-178638 A1 6/2004
JP 2005-56652 A1 3/2005

* cited by examiner

*Primary Examiner*—Chau N Nguyen
(74) *Attorney, Agent, or Firm*—Kratz, Quintos & Hanson, LLP

(57) ABSTRACT

A tinsel wire is provided, which has a high mechanical strength as an electric power supplying conductor wire, hardly breaks with respect to a vibration of the diaphragm, has small dynamic resistance even in a vibrating atmosphere, has excellent flexing characteristics, thereby improving quality and reliability as a product, enables a thin designing of a product, and increases the freedom of the designing. The tinsel wire includes an assembled wire which includes a plurality of element wires each including core threads and a metal foil wound up around the core threads, the plurality of the element wires twisted, bundled or woven together constituting the assembled wire, wherein a cross section of the tinsel wire has a shape of a polygon selected from the group consisting of a quadrilateral, pentagon, hexagon and octagon.

10 Claims, 8 Drawing Sheets

TINSEL WIRE

BACKGROUND OF THE INVENTION (1) Field of the Invention

The present invention relates to a tinsel wire, which is used, for example, as part of a voice coil for driving a speaker diaphragm in acoustic equipment or as an electric power supplying wire material for connecting a game machine body to a controller. Such a tinsel wire has high mechanical strength as a wire material and excellent flexing characteristics, thereby improving quality and reliability as a product.

(2) Description of the Related Art

Recently, for example, as for a speaker in acoustic equipment, a voice output having high quality, that is, a voice output having less acoustic distortion with respect to a high frequency component or high power input has been required. As for a voice coil for driving a diaphragm, a voice coil having predetermined mechanical strength and resistance values has been required.

As an electric power supplying conductor wire such as a voice coil for driving a diaphragm, there is a tinsel wire including an assembled wire formed by twisting, bundling or weaving together a desired number of element wires, in each of which a flat conductor having a rectangular shape in section is wound up around core threads. Such an electric power supplying conductor wire has a flexibility and small dynamic resistance even in a vibrating atmosphere and hardly breaks with respect to a vibration of the diaphragm (for example, see Japanese Patent Application Laid-Open No. 2004-178638).

Further, as a long aerial coated wire such as an electrically insulating wire to be provided aerially or a tube-shaped protector protecting an optical cable, there is an aerial insulating wire, an outer surface of a coating of which has a rectangular shape having, which has triangular ridge parts, of the number same as that of the sides, arranged at even intervals in a circumferential direction, by connecting the equilateral sides, the number of which is three or more, in the circumferential direction so as to inscribe it to a circle of an outer diameter thereof, wherein the number of the sides is in a range of from $6.785+0.575d-0.006732d^2$ to $6.949+0.8380d-0.009694d^2$ in a relation between the number of the sides and the outer diameter d. Such an aerial insulating wire restrains an increase of a drag coefficient so as to avoid an estimation of the drag coefficient under a condition of strong wind and rainfall in the open air, allowing the drag coefficient to decrease and preventing the outer diameter and weight of the coating from increasing (for example, see Japanese Patent Application Laid-Open No. 2005-56652).

However, when the electric power supplying conductor wire disclosed in Japanese Patent Application Laid-Open No. 2004-178638 is used, for example, as a voice coil for driving a speaker diaphragm in acoustic equipment, a mechanical strength as a wire material is not sufficient in a vibrating atmosphere, flexing characteristics are not good, a vibration amplitude of the diaphragm is deteriorated, a resonance is generated in the voice coil at a specific frequency, causing so-called a rope jumping phenomenon that a tinsel wire collides with the diaphragm and causing abnormal noise. Therefore, such an electric power supplying conductor wire lacks of performance and reliability of a speaker as a product. Further, a receiving space, in which the voice coil as the electric power supplying conductor is arranged, is not suitable for a thin designing of a speaker in a narrow arranging space between the diaphragm and a damper.

The long aerial coated wire such as an electrically insulating wire to be provided aerially or a tube-shaped protector protecting an optical cable disclosed in Japanese Patent Application Laid-Open No. 2005-56652 is for the purpose of restraining the increase of the drag coefficient under a condition of strong wind and rainfall in the open air, that is, for use in the open air, and therefore, is neither for the purpose of indoor use of the electric power supplying conductor wire nor for the purpose of use the electric power supplying conductor wire in electric or electronic equipment. Further, as for the long aerial coated wire disclosed in Japanese Patent Application Laid-Open No. 2005-56652, since a wire diameter and a weight per unit length of the insulating wire or optical cable is large in order to improve its mechanical strength as a wire to be used in the open air, therefore values thereof are significantly large after adding the size of the protector for protecting the insulating wire or optical cable. That is, the concept of the electric power supplying conductor wire itself is different from that of a wire intending an excellent dynamic following property with respect to a dynamic system such as a speaker diaphragm. An increase in the weight of a tinsel wire itself for use in a speaker causes deterioration in a sound pressure level and biased loading onto the diaphragm causing a rolling motion of the diaphragm. Furthermore, it causes a resonance in the voice coil at a specific frequency and a problem that it tends to generate so-called a rope jumping phenomenon.

SUMMARY OF THE INVENTION

It is therefore an objective of the present invention to solve the above problems and to provide a tinsel wire, which has a high mechanical strength as an electric power supplying conductor wire, hardly breaks with respect to a vibration of the diaphragm, has small dynamic resistance even in a vibrating atmosphere, has excellent flexing characteristics, thereby improving quality and reliability as a product, enables a thin designing of a product, and increases the freedom of the designing.

In order to attain the above objective, the present invention is to provide a tinsel wire including an assembled wire which includes a plurality of element wires each including core threads and a metal foil wound up around the core threads, the plurality of the element wires twisted, bundled or woven together constituting the assembled wire, wherein a cross section of the tinsel wire has a shape of a polygon selected from the group consisting of a quadrilateral, pentagon, hexagon and octagon. For example, the metal foil is a gold foil, silver foil, copper foil or a metal foil formed by metal plating.

According to the present invention described above, a tinsel wire is provided, which has a high mechanical strength as an electric power supplying conductor wire, hardly breaks, has a small dynamic resistance even in a vibrating atmosphere when it is used as a voice coil for driving a speaker diaphragm, has excellent flexing characteristics and follow-up characteristics to a diaphragm, prevents a resonance from being generated at a specific frequency since the tinsel wire can be made light. The tinsel wire is free from so-called a rope jumping phenomenon that a tinsel wire collides with the diaphragm and free from abnormal noise. The tinsel wire is free from deterioration in a sound pressure level, from a biased loading or a rolling motion of the diaphragm, thereby improving quality and reliability as a product, enables a thin designing of a product, and increases the freedom of the designing.

The quadrilateral is a square, rectangle or rhombus.

With the construction described above, the effects of the present invention as described above are further attained.

The cross section of the tinsel wire has a shape of a quadrilateral, wherein in the cross section thereof the tinsel wire includes: a plurality of the first element wires, each having a large diameter, arranged in the middle of the cross section of the tinsel wire; and a plurality of the second element wires, each having a small diameter, arranged around the first element wires.

With the construction described above, the effects of the present invention as described above are further attained.

A length of one side of the cross section of the tinsel wire is equal to or longer than 70% of a length of another side of the cross section of the tinsel wire.

With the construction described above, the effects of the present invention as described above are further attained.

The tinsel wire is coated with an electrically insulating coating, a cross section of which has a shape of a polygon selected from the group consisting of a quadrilateral, pentagon, hexagon and octagon.

With the construction described above, since the tinsel wire is coated with the electrically insulating coating, therefore the tinsel wire has a good electrically insulating property. Further, since the cross section of the electrically insulating coating has a shape of a polygon, therefore the tinsel wire can be easily securely constructed and assembled. The effects of the present invention as described above are further attained.

The electrically insulating coating is made of synthetic resin, rubber, fibers dipped in resin (i.e. fibers subjected to a dipping treatment in resin) or fibers dipped in rubber (i.e. fibers subjected to a dipping treatment in rubber).

With the construction described above, the tinsel wire has a good electrically insulating property and the tinsel wire can be easily securely constructed and assembled. The effects of the present invention as described above are further attained.

According to the present invention, a tinsel wire can be provided, which has a high mechanical strength as an electric power supplying conductor wire, hardly breaks with respect to a vibration of the diaphragm, has small dynamic resistance even in a vibrating atmosphere, has excellent flexing characteristics, thereby improving quality and reliability as a product, enables a thin designing of a product, and increases the freedom of the designing.

DESCRIPTION OF THE PREFERRED EMBODIMENTS

Figure 1:
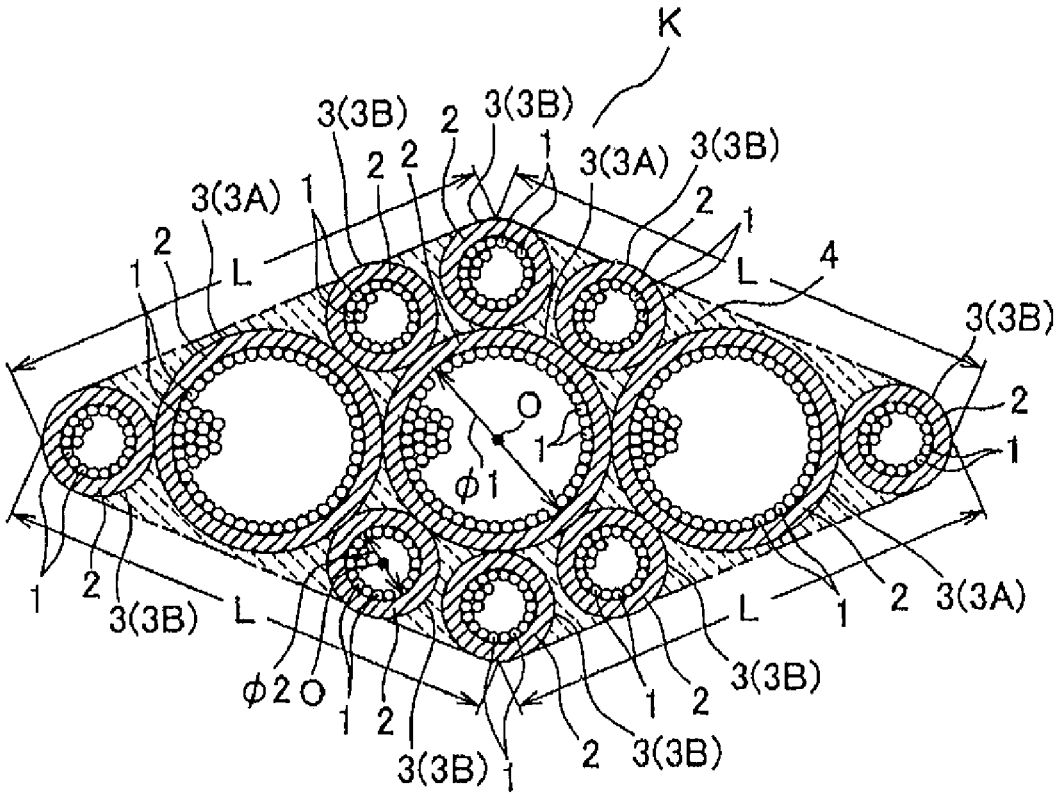
FIG. 1 is an enlarged cross sectional view illustrating a tinsel wire according to the first preferred embodiment of the present invention.
Figure 2:
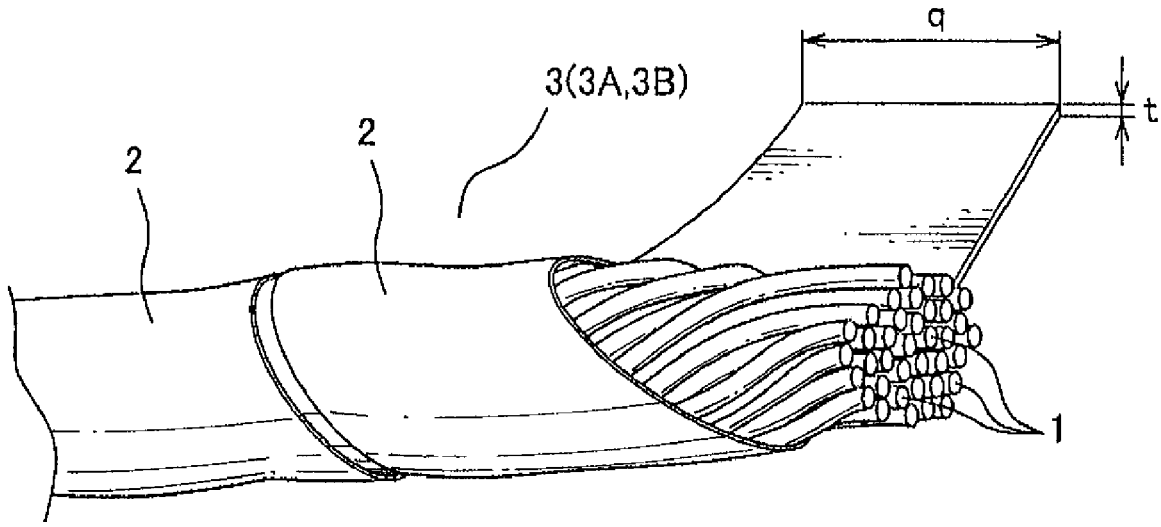
FIG. 2 is a perspective view illustrating an element wire constructing a tinsel wire.

In the following, the preferred embodiments of the present invention will be explained with reference to the attached drawings.

First Preferred Embodiment

A tinsel wire K includes an assembled wire formed by twisting, bundling or weaving a predetermined number of element wires 3, each of which includes core threads 1 and a metal foil 2 wound up around the core threads 1. The metal foil 2 is, for example, a gold foil, silver foil, copper foil or a foil of other metals. The metal foil 2 may be formed by plating.

In the first preferred embodiment, a cross section of the tinsel wire K has a shape of a quadrilateral as the polygon. In an example shown in FIG. 1, the quadrilateral is a rhombus. The quadrilateral may be a square or rectangle instead of a rhombus.

A predetermined number of the core threads 1 are twisted and a copper foil as the metal foil 2 having a width q of 0.3 mm and a thickness t of 0.023 mm is wound up around the core threads 1, thereby the element wire 3 is formed. The core thread 1 may be an aramid fiber having high mechanical strength, excellent elastic property, low stretching property, excellent heat resisting property and excellent insulating property. Alternatively, the core thread 1 may be a fiber of a resin such as polyamide resin, polyimide resin, fluorocarbon resin, polyethylene resin, polyvinyl chloride having high mechanical strength, excellent elastic property, low stretching property, excellent heat resisting property and excellent insulating property. Further, the core thread 1 may be a cotton yarn. The metal foil 2 may have a naked outer surface or an outer surface subjected to an insulating treatment by using an insulating material. Such an insulating material may be synthetic resin or rubber.

The tinsel wire K includes an assembled wire 4, which is formed by twisting a predetermined number of element wires 3. In an example shown in FIG. 1, eleven element wires 3 are twisted to form the assembled wire 4. Alternatively, the tinsel wire K includes an assembled wire 4, which is formed by weaving a predetermined number of element wires 3 (not shown in the figure).

In the first preferred embodiment, as shown in FIG. 1, the tinsel wire K having a rhomboid-shape in section having four sides each having the same length L. However, instead, the tinsel wire K may principally have a deformed quadrilateral shape in section, in which at least one side of three sides of the deformed quadrilateral shape has a length L1 that is equal to or larger than 70% of a length L of the remaining side of the deformed quadrilateral shape. For example, as shown in FIG.

3, the tinsel wire K may have a deformed quadrilateral shape in section, in which a length L1 of each of two short sides of the deformed quadrilateral shape is equal to or larger than 70% of a length L of each of the remaining two long sides of the deformed quadrilateral shape.

In the first preferred embodiment, as shown in FIG. 1, the tinsel wire K, which is formed with the assembled wire 4 including the element wires 3, has three element wires 3A each having a large diameter ϕ1 arranged in a row laterally in the middle of the cross section of the tinsel wire K and eight element wires 3B each having a small diameter ϕ2 arranged around the element wires 3A, that is, three at the upper side of the central element wire 3A, three at the lower side of the central element wire 3A, and two at right and left sides of the corresponding element wires 3A, and as a whole, a structure of the assembled wire 4 is stably balanced with regard to a right-and-left direction thereof. Each of the element wires 3A and the element wires 3B is formed with core threads 1 of a predetermined number and a metal foil 2 wound up around the outer circumference of the core threads 1. Here, a thickness and number of the core threads 1 and the number of times of the winding of the metal foil 2 around the outer circumference of the core threads 1 are appropriately selected.

With the construction of the tinsel wire K as described above, the mechanical strength of the tinsel wire K becomes strong in an environment having frequent vibration in comparison with a case in which a tinsel wire constructed with element wires having the same thickness is used. Further, such a tinsel wire K as described above has excellent flexing characteristics and follow-up characteristics to a diaphragm, prevents a resonance from being generated at a specific frequency since the tinsel wire can be made light. The tinsel wire K is free from so-called a rope jumping phenomenon that a tinsel wire collides with the diaphragm and free from abnormal noise.

As described above, in the first preferred embodiment of the present invention, the tinsel wire K includes the assembled wire 4 formed by twisting, bundling or weaving a predetermined number of the element wires 3, each of which includes the core threads 1 and the metal foil 2 wound up around the core threads 1, wherein the cross section of the tinsel wire K has a shape of a quadrilateral as shown in FIG. 1, therefore the bending property of the tinsel wire K is significantly improved.

Figure 4:
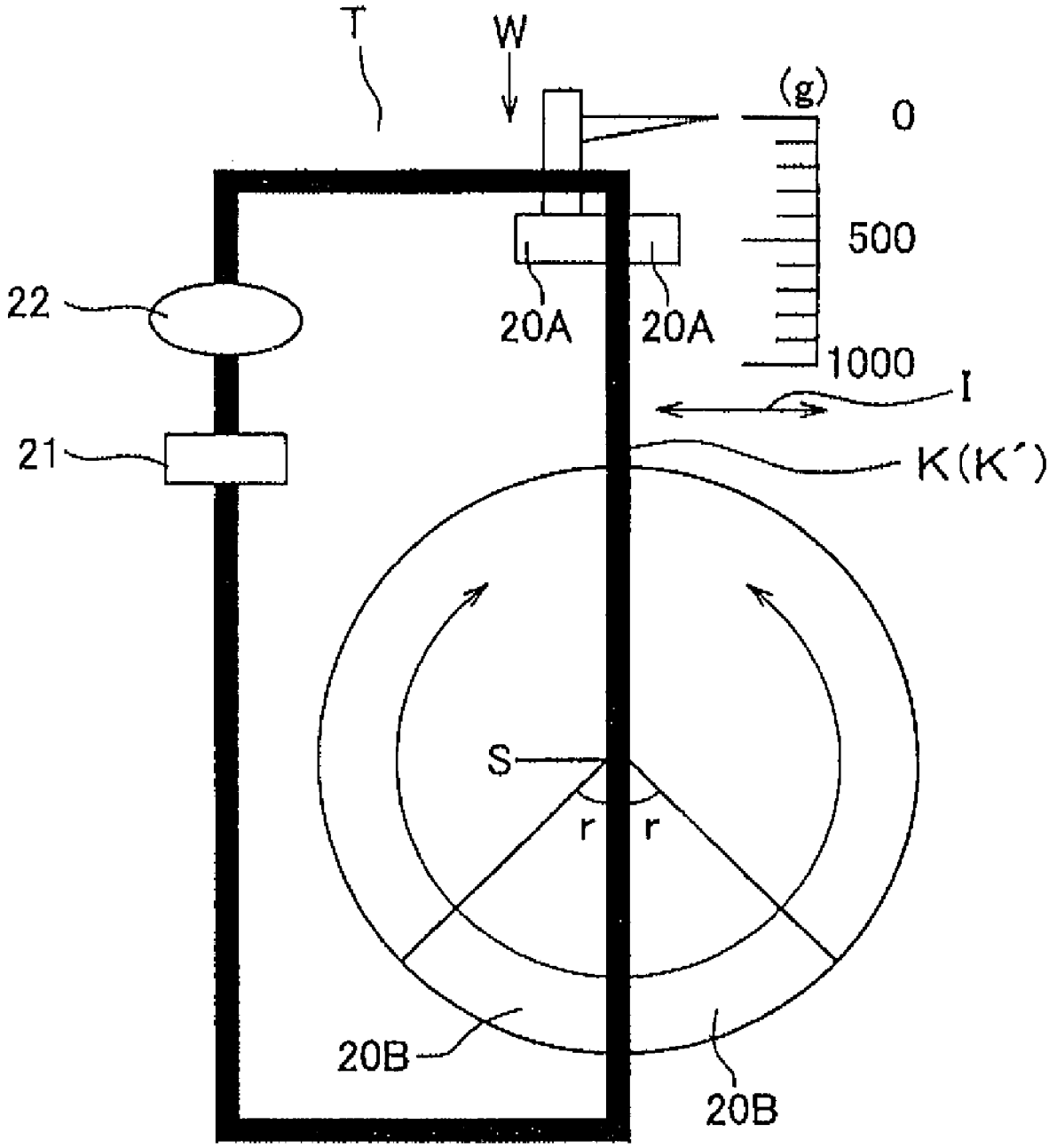
FIG. 4 is a front view illustrating a bending tester for measuring a mechanical strength of a tinsel wire.

As for the tinsel wire K obtained in the first preferred embodiment, a bending test was carried out by using a bending tester T as shown in FIG. 4. The bending tester T includes: sample holding members 20A, 20B which hold upper and lower sides of a sample forming a circuit upon performing the bending test by being opened or closed with a driving mechanism (not shown in the figure); power supply 21 which supplies a current to the sample; and an electric light bulb 22 which is turned on or turned off when a current from the power supply 21 flows or does not flow, depending on if the metal foil 2 of the sample is broken at a point of action S of the sample holding member 20B due to fatigue, wherein a load W is applied on the sample while the sample is shaken in a thickness direction I of the sample to be bent. A reference sign r denotes an angle of bend.

The above bending test was carried out as to the tinsel wire K obtained according to the first preferred embodiment of the present invention described above and as to a conventional tinsel wire K', regarding four samples of the tinsel wire K and four samples of the conventional tinsel wire K', wherein an aramid fiber was used for each core thread of the tinsel wire K and K'.

As shown in FIG. 1, a cross section of the tinsel wire K had a shape of a rhombus.

Figure 5:
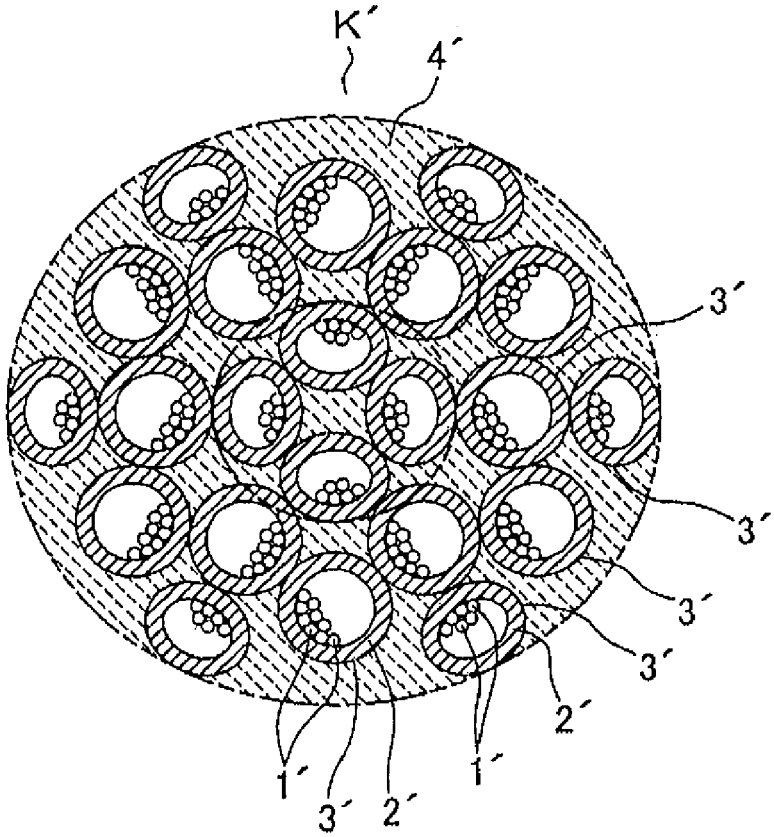
FIG. 5 PRIOR ART
FIG. 5 is an enlarged cross sectional view illustrating a comparative example of a tinsel wire.
Figure 6:
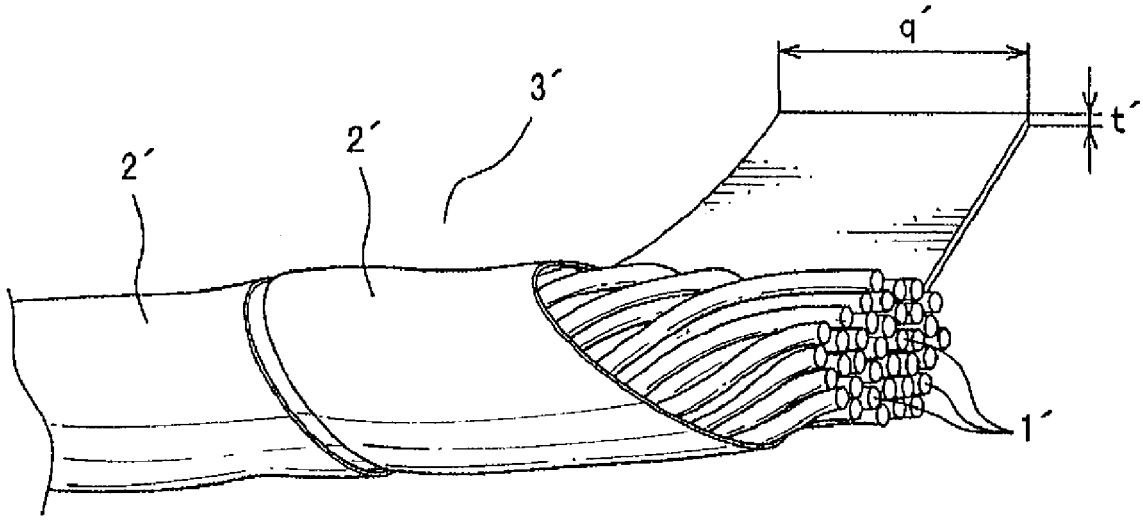
FIG. 6 PRIOR ART
FIG. 6 is a perspective view illustrating an element wire constructing the comparative example of the tinsel wire.

As shown in FIGS. 5 and 6, the conventional tinsel wire K' was formed by twisting core threads 1', which was an aramid fiber, then by winding a metal foil 2' consisting of a copper foil as an electrical conductor having a width q' of 0.3 mm and a thickness t' of 0.023 mm around the twisted core threads 1' so as to form 22 element wires 3' having a small diameter as shown in FIG. 5, and finally by twisting the element wires 3' so as to form an assembled wire 4'.

As shown in FIG. 5, a cross section of the tinsel wire K' had a round shape.

In the bending test, upper and lower sides of each sample K, K' were held (clamped) by the sample holding members 20A, 20B of the bending tester T, respectively, then each sample was bent in the thickness direction I of the sample while the sample was applied with a load W thereon. The number of times of bend was counted until the metal foil 2, 2' of the sample was broken due to fatigue of the metal foil. The electric light bulb 22 showed whether or not the metal foil 2, 2' was broken.

In detail, the above bending test was carried out on a condition that an angle of bend being 270 degree, speed of bend being 180 bends/minute, load being 500 grams, and the minimum radius of bend being 1.5 mm. The results are shown in Table 1.

TABLE 1

| Counted Number of Times of Bend | | |
|---|---|---|
| Sample | Comparative Example | Example |
| No. 1 | 11756 | 41298 |
| No. 2 | 8441 | 33805 |
| No. 3 | 6616 | 43026 |
| No. 4 | 6120 | 39885 |
| Average | 8233 | 39504 |

Table 1 reveals that the average value of the counted number of times of bend is 8233 for the comparative example (tinsel wire K'), whereas that of the counted number of times of bend is 39504 for the example according to the present invention (tinsel wire K). Therefore, the tinsel wire K according to the present invention has about 4.8 times as strong as the conventional tinsel wire K' in terms of bending strength.

Therefore, when the tinsel wire K according to the first preferred embodiment of the present invention is used as part of a voice coil for driving a speaker diaphragm, the tinsel wire K has a high mechanical strength as an electric power supplying conductor wire, hardly breaks with respect to a vibration of the diaphragm, has small dynamic resistance even in a vibrating atmosphere, has excellent flexing characteristics, thereby improving quality and reliability as a product, enables a thin designing of a product, and increases the freedom of the designing.

Further, the tinsel wire K has excellent follow-up characteristics to a diaphragm, prevents a resonance from being generated at a specific frequency since the tinsel wire K can be made light, and is free from so-called a rope jumping phenomenon that a tinsel wire collides with the diaphragm and free from abnormal noise. Furthermore, the tinsel wire K is free from deterioration in a sound pressure level and free from a biased loading or a rolling motion of the diaphragm.

Second Preferred Embodiment

Figure 7:
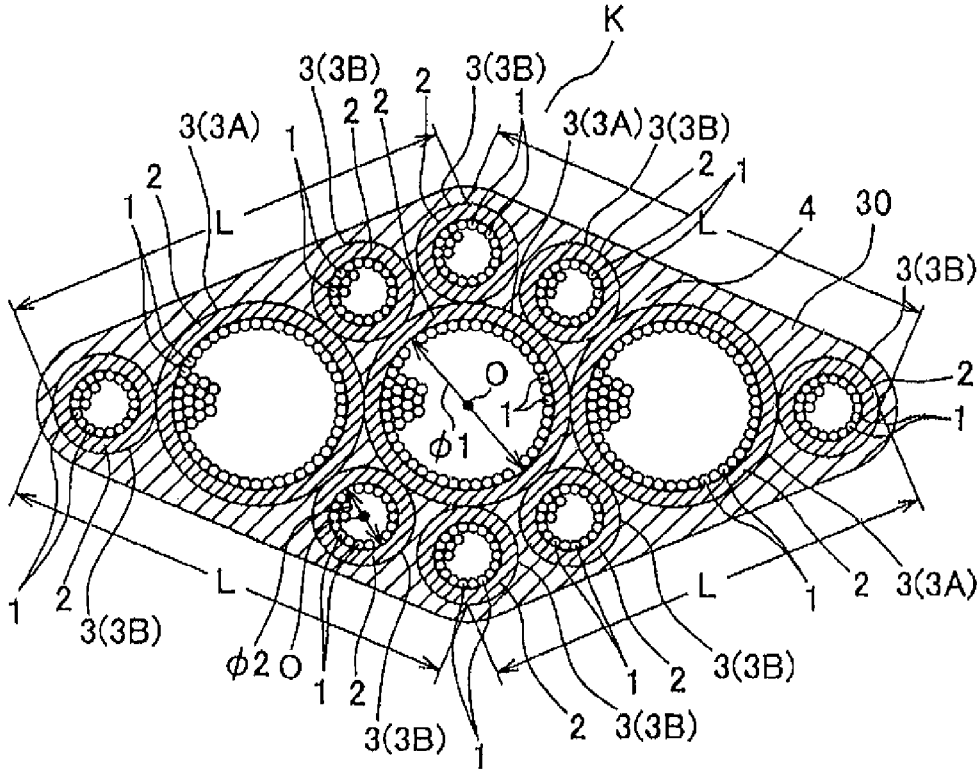
FIG. 7 is an enlarged cross sectional view illustrating a tinsel wire having a quadrilateral shape in section according to the second preferred embodiment of the present invention.

FIG. 7 shows a tinsel wire according to the second preferred embodiment of the present invention, in which the tinsel wire K is coated with an electrically insulating coating 30 having a cross section of a quadrilateral shape. The electrically insulating coating 30 is made of synthetic resin such as polyvinyl acetate resin, polyvinyl chloride resin, silicon resin, fluorocarbon resin, polyurethane resin, polyamide resin, polyimide resin, polyester resin or polyethylene resin, rubber, fibers dipped in the synthetic resin described above or fibers dipped in rubber. Except for the electrically insulating coating 30, the tinsel wire according to the second preferred embodiment of the present invention has the same construction and action as those of the tinsel wire according to the first preferred embodiment of the present invention.

In the second preferred embodiment of the present invention, since the tinsel wire K is coated with the electrically insulating coating 30, therefore the tinsel wire K has a good electrically insulating property. Further, since the cross section of the electrically insulating coating has a shape of a quadrilateral, therefore the tinsel wire K can be easily securely constructed and assembled. Furthermore, the effects of the present invention as described above are attained. The tinsel wire K has a long life time.

Third Preferred Embodiment

Figure 8:
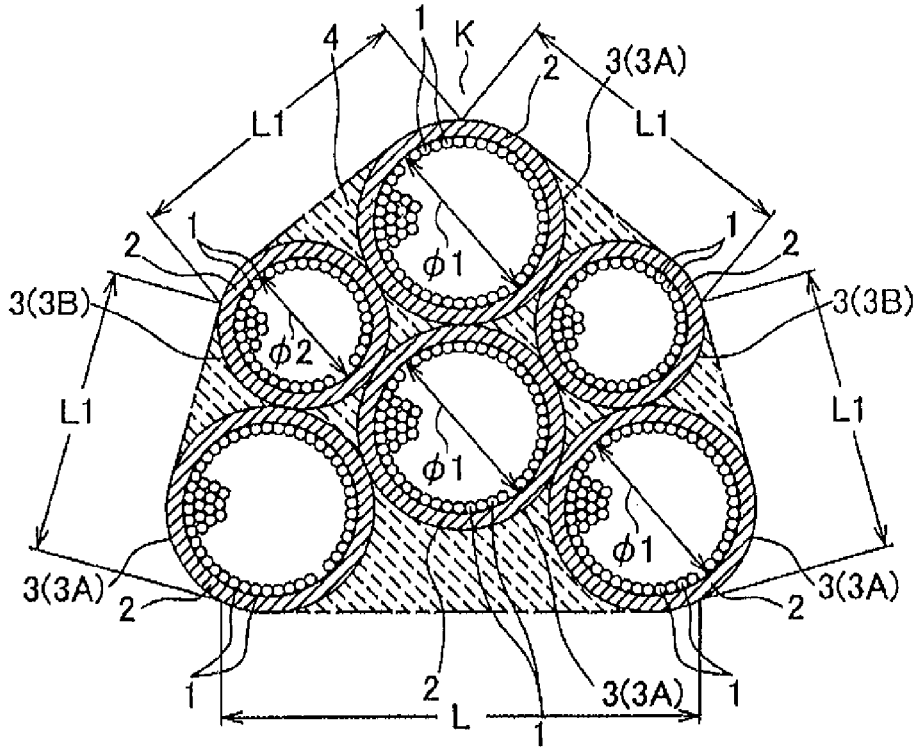
FIG. 8 is an enlarged cross sectional view illustrating a tinsel wire having a pentagonal shape in section according to the third preferred embodiment of the present invention.

A tinsel wire according to the third preferred embodiment of the present invention is shown in FIG. 8.

In the third preferred embodiment, as shown in FIG. 8, a cross section of the tinsel wire K has a shape of a pentagon, wherein the tinsel wire K has three element wires 3A each having a large diameter ϕ1 arranged in a row laterally at the lower side, one element wire 3A at the center at the upper side, and two element wires 33 each having a small diameter ϕ2 arranged at the right side and at the left side of the central element wire 3A. Therefore, the cross section of the tinsel wire K is formed stable being balanced in the left and right direction.

Fourth Preferred Embodiment

Figure 9:
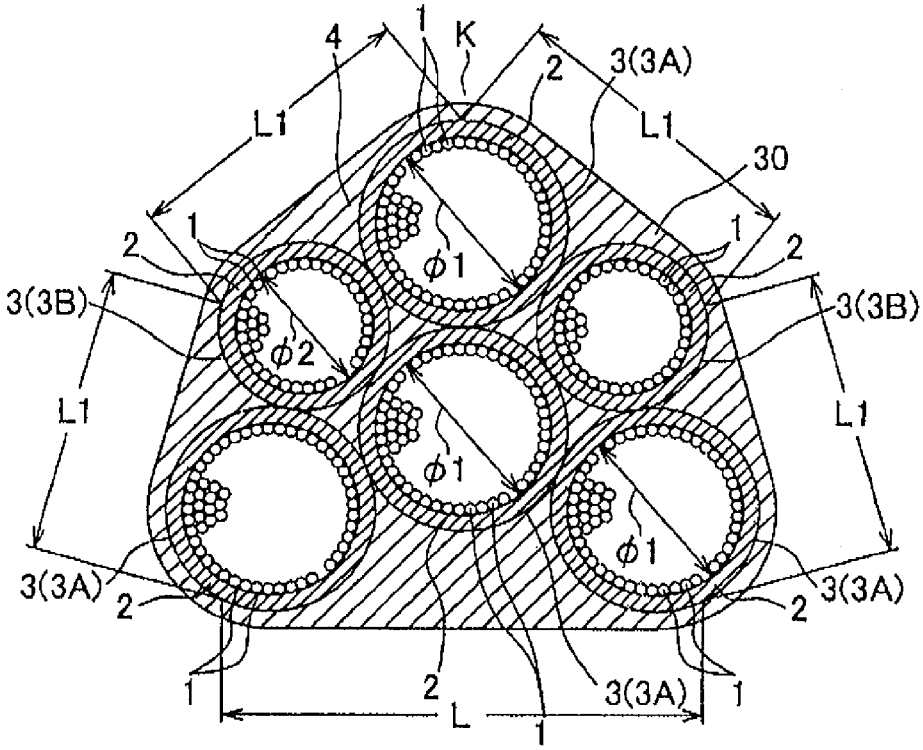
FIG. 9 is an enlarged cross sectional view illustrating a tinsel wire having a pentagonal shape in section according to the fourth preferred embodiment of the present invention.

FIG. 9 shows a tinsel wire according to the fourth preferred embodiment of the present invention, in which the tinsel wire K having a cross section of a pentagonal shape is coated with an electrically insulating coating 30 having a cross section of a pentagonal shape. The electrically insulating coating 30 is made of synthetic resin, rubber, fibers dipped in synthetic resin or fibers dipped in rubber as described above.

In the fourth preferred embodiment of the present invention, since the tinsel wire K is coated with the electrically insulating coating 30, therefore the tinsel wire K has a good electrically insulating property. Further, since the cross section of the electrically insulating coating has a shape of a pentagon, therefore the tinsel wire K can be easily securely constructed and assembled. Furthermore, the effects of the present invention as described above are attained. The tinsel wire K has a long life time.

Fifth Preferred Embodiment

Figure 10:
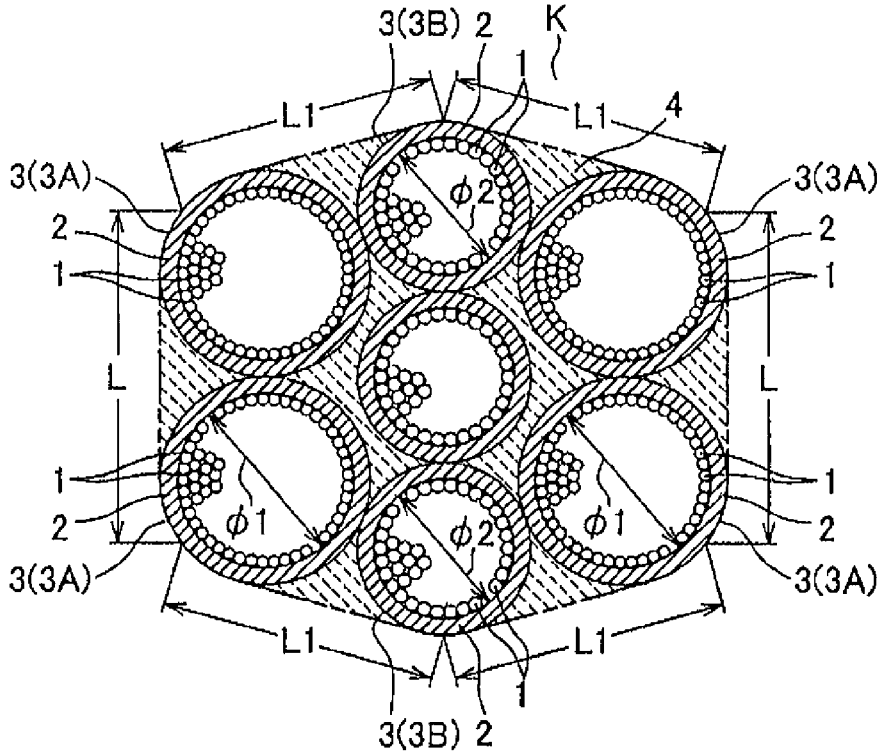
FIG. 10 is an enlarged cross sectional view illustrating a tinsel wire having a hexagonal shape in section according to the fifth preferred embodiment of the present invention.

A tinsel wire according to the fifth preferred embodiment of the present invention is shown in FIG. 10.

In the fifth preferred embodiment, as shown in FIG. 10, a cross section of the tinsel wire K has a shape of a hexagon, wherein the tinsel wire K has two element wires 3A each having a large diameter ϕ1 arranged in a row longitudinally at the left side, two element wires 3A each having a large diameter ϕ1 arranged in a row longitudinally at the right side, and three element wires 3B each having a small diameter ϕ2 arranged in a row longitudinally at the center. Therefore, the cross section of the tinsel wire K is formed stable being balanced in the left and right direction.

Sixth Preferred Embodiment

Figure 11:
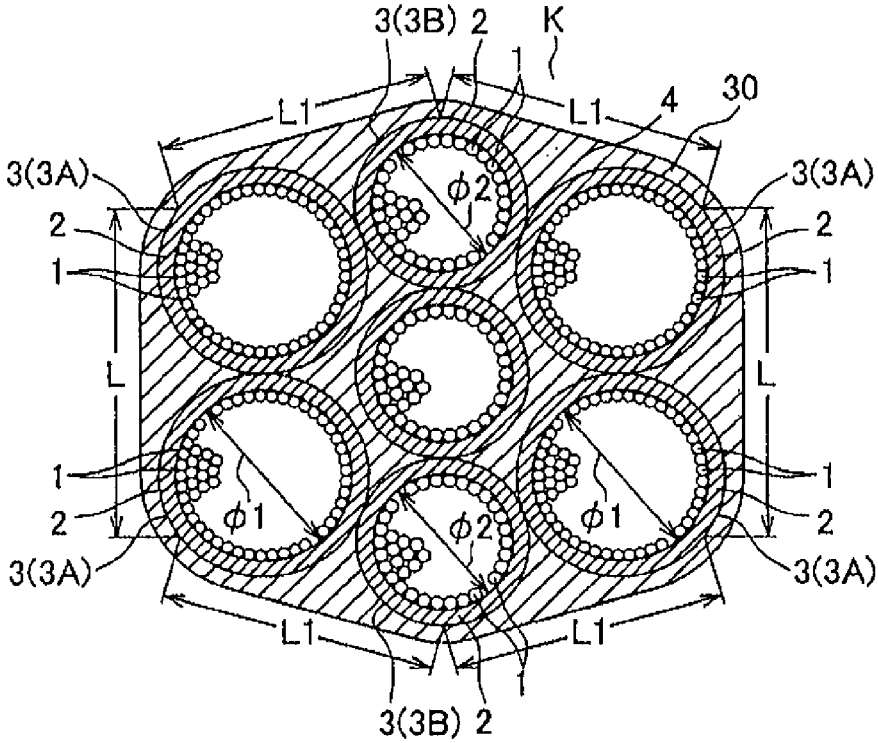
FIG. 11 is an enlarged cross sectional view illustrating a tinsel wire having a hexagonal shape in section according to the sixth preferred embodiment of the present invention.

A tinsel wire according to the sixth preferred embodiment of the present invention is shown in FIG. 11.

In the sixth preferred embodiment, as shown in FIG. 11, the tinsel wire K having a cross section of a hexagonal shape is coated with an electrically insulating coating 30 having a cross section of a hexagonal shape. The electrically insulating coating 30 is made of synthetic resin, rubber, fibers dipped in synthetic resin or fibers dipped in rubber as described above.

In the sixth preferred embodiment of the present invention, since the tinsel wire K is coated with the electrically insulating coating 30, therefore the tinsel wire K has a good electrically insulating property. Further, since the cross section of the electrically insulating coating has a shape of a hexagon, therefore the tinsel wire K can be easily securely constructed and assembled. Furthermore, the effects of the present invention as described above are attained. The tinsel wire K has a long life time.

Seventh Preferred Embodiment

Figure 12:
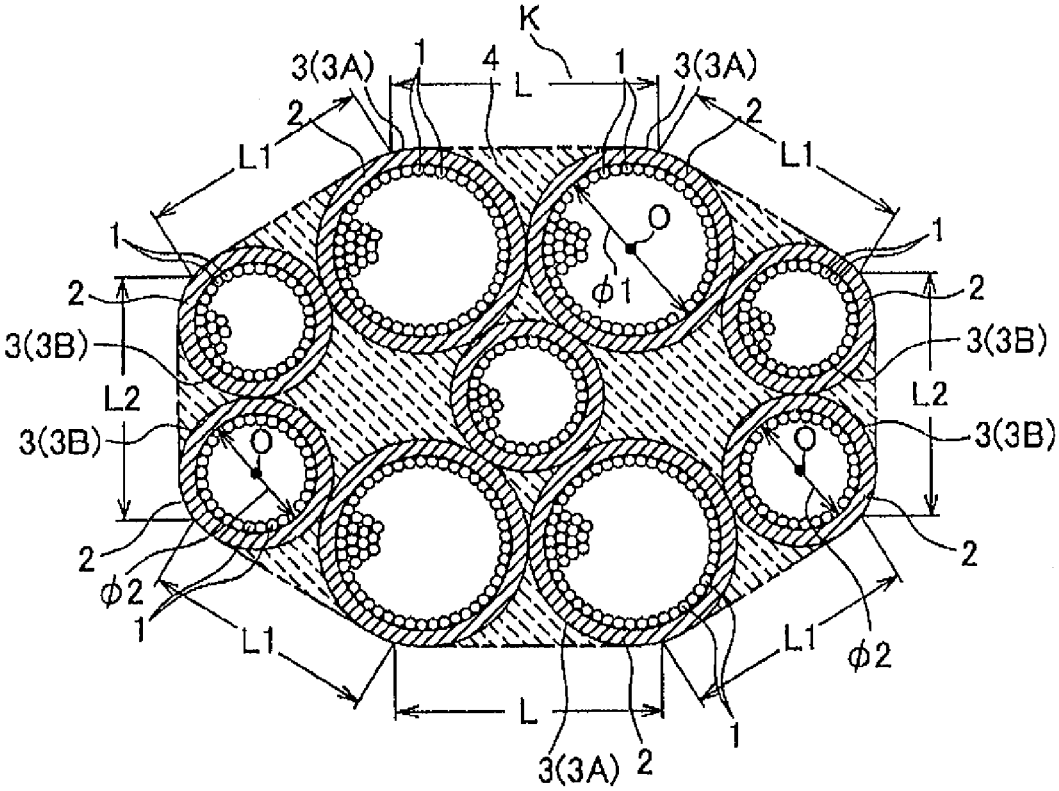
FIG. 12 is an enlarged cross sectional view illustrating a tinsel wire having an octagonal shape in section according to the seventh preferred embodiment of the present invention.

A tinsel wire according to the seventh preferred embodiment of the present invention is shown in FIG. 12.

In the seventh preferred embodiment, as shown in FIG. 12, a cross is section of the tinsel wire K has a shape of an octagon, wherein the tinsel wire K has two element wires 3B each having a small diameter ϕ2 arranged in a row longitudinally at the left side, two element wires 3B each having a small diameter ϕ2 arranged in a row longitudinally at the right side, one element wire 3B having a small diameter ϕ2 arranged at the center, two element wires 3A each having a large diameter ϕ1 arranged in a row longitudinally at the left side of the central element wire 3B, and two element wires 3A each having a large diameter ϕ1 arranged in a row longitudinally at the right side of the central element wire 3B. Therefore, the cross section of the tinsel wire K is formed stable being balanced in the left and right direction.

Eighth Preferred Embodiment

Figure 13:
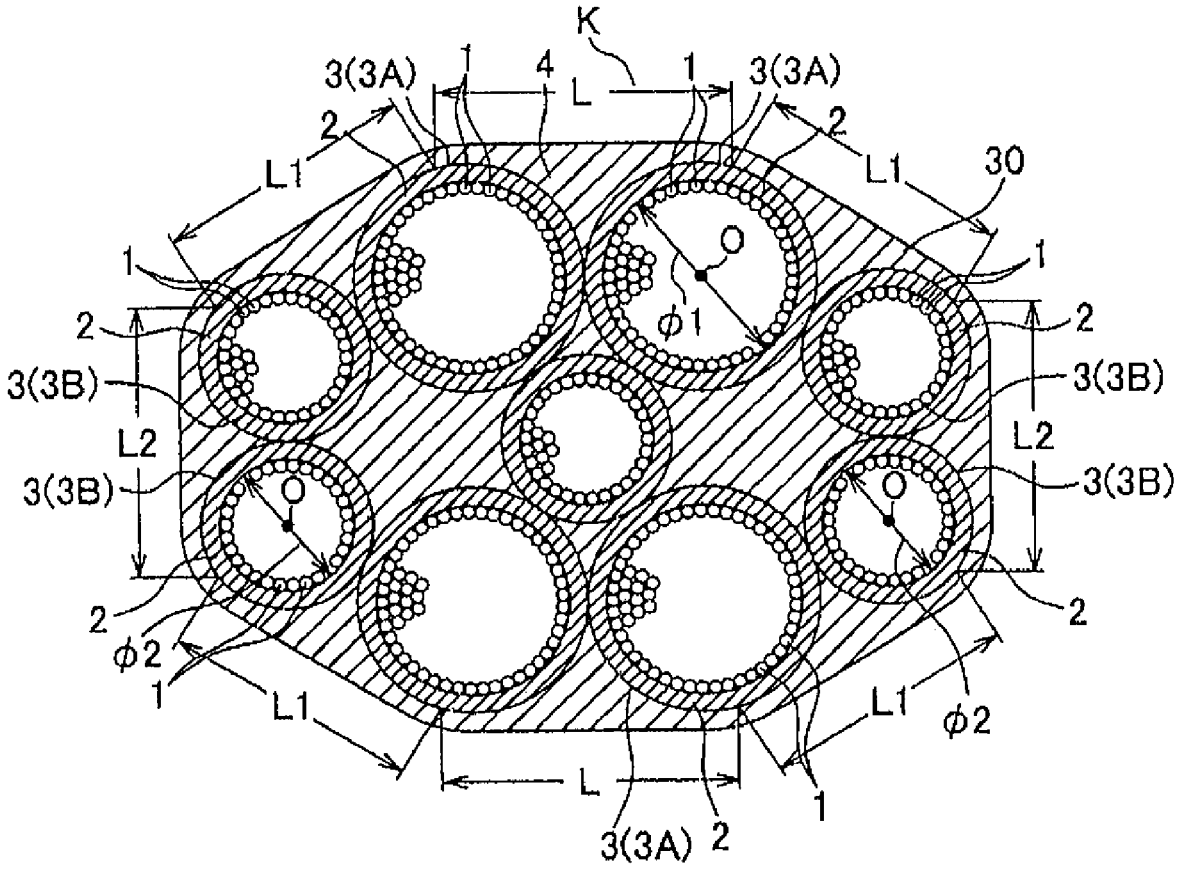
FIG. 13 is an enlarged cross sectional view illustrating a tinsel wire having an octagonal shape in section according to the eighth preferred embodiment of the present invention.

A tinsel wire according to the eighth preferred embodiment of the present invention is shown in FIG. 13.

In the eighth preferred embodiment, as shown in FIG. 13, the tinsel wire K having a cross section of an octagonal shape is coated with an electrically insulating coating 30 having a cross section of an octagonal shape. The electrically insulating coating 30 is made of synthetic resin, rubber, fibers dipped in synthetic resin or fibers dipped in rubber as described above.

In the eighth preferred embodiment of the present invention, since the tinsel wire K is coated with the electrically insulating coating 30, therefore the tinsel wire K has a good electrically insulating property. Further, since the cross section of the electrically insulating coating has a shape of an octagon, therefore the tinsel wire K can be easily securely constructed and assembled. Furthermore, the effects of the present invention as described above are attained. The tinsel wire K has a long life time.

Figure 3:
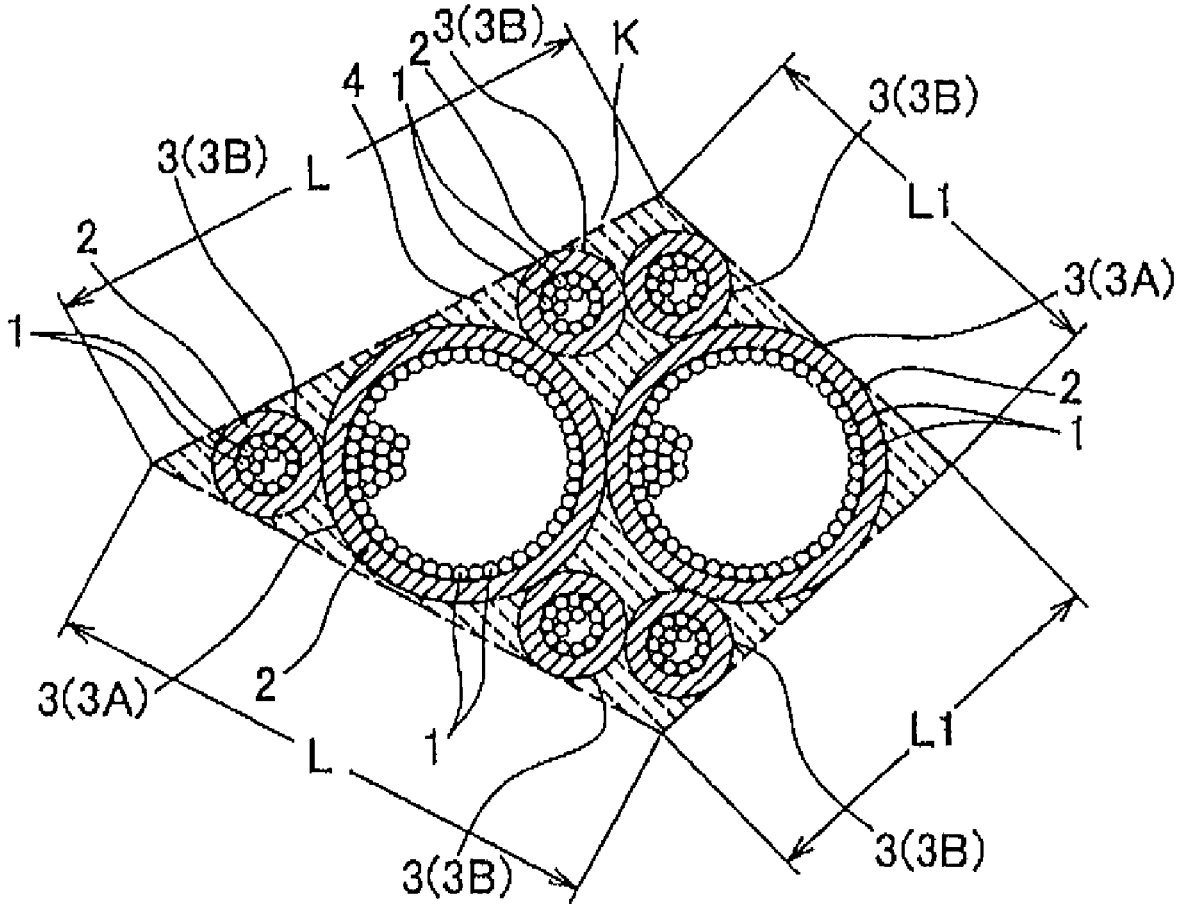
FIG. 3 is an enlarged cross sectional view illustrating a modified example of a tinsel wire according to the first preferred embodiment of the present invention.

In a case in which a cross section of the tinsel wire K has a quadrilateral shape, the cross section may be an equilateral quadrilateral as shown in FIG. 1, or the cross section may not be equilateral but, for example, a quadrilateral, in which a length L1 of each of two short sides is equal to or longer than 70% of a length L of each of two long sides as shown in FIG. 3.

In a case in which a cross section of the tinsel wire K has a pentagonal shape, the cross section may be an equilateral pentagon, or the cross section may not be equilateral but, for example, a pentagon, in which a length L1 of each of four short sides is equal to or longer than 70% of a length L of a long side as shown in FIGS. 8 and 9.

In a case in which a cross section of the tinsel wire K has a hexagonal shape, the cross section may be an equilateral hexagon, or the cross section may not be equilateral but, for example, a hexagon, in which a length L1 of each of four short sides is equal to or longer than 70% of a length L of each of two long sides as shown in FIGS. 10 and 11.

In a case in which a cross section of the tinsel wire K has an octagonal shape, the cross section may be an equilateral octagon, or the cross section may not be equilateral but, for example, an octagon, in which a length L1 of each of four short sides and a length L2 of each of two short sides are equal to or longer than 70% of a length L of each of two long sides as shown in FIGS. 12 and 13.

In each of the above cases, generally in the present invention, a length of one side (i.e. short side) of the cross section of the tinsel wire is equal to or longer than 70% of a length of another side (i.e. long side) of the cross section of the tinsel wire.

In each of the above cases, in which a cross section of the tinsel wire K has a shape of a polygon selected from the group consisting of a quadrilateral, pentagon, hexagon and octagon, since a length of a short side of the polygon is equal to or longer than 70% of a length of a long side of the polygon, therefore the flexibility of the tinsel wire K is prevented from deteriorating, a resonance in a voice coil at a specific frequency is prevented from occurring, so-called a rope jumping phenomenon in which a tinsel wire collides with a diaphragm is prevented from occurring, and an abnormal noise is prevented from occurring.

The aforementioned preferred embodiments are described to aid in understanding the present invention and variations may be made by one skilled in the art without departing from the spirit and scope of the present invention.

What is claimed is:

1. A tinsel wire comprising an assembled wire which includes a plurality of element wires each including core threads and a metal foil wound up around the core threads, the plurality of the element wires twisted, bundled or woven together constituting the assembled wire, wherein a cross section of the tinsel wire includes:

a first plurality of the element wires, each having a large diameter, and a second plurality of the element wires, each having a small diameter, wherein at least a portion of the plurality of first element wires and second element wires are not parallel with each other, and the cross-section of the tinsel wire has a shape of a polygon selected from the group consisting of a quadrilateral, pentagon, hexagon and octagon.

2. The tinsel wire according to claim 1, wherein the quadrilateral is a square, rectangle or rhombus.

3. The tinsel wire according to claim 1, wherein a length of one side of the cross section of the tinsel wire is equal to or longer than 70% of a length of another side of the cross section of the tinsel wire.

4. The tinsel wire according to claim 1, wherein the tinsel wire is coated with an electrically insulating coating, a cross section of which has a shape of a polygon selected from the group consisting of a quadrilateral, pentagon, hexagon and octagon.

5. The tinsel wire according to claim 4, wherein the electrically insulating coating is made of synthetic resin, rubber, fibers dipped in resin or fibers dipped in rubber.

6. A tinsel wire comprising an assembled wire which includes a plurality of element wires each including core threads and a metal foil wound up around the core threads, the plurality of the element wires twisted, bundled or woven together constituting the assembled wire, wherein a cross section of the tinsel wire has a shape of a polygon, and wherein the cross section of the tinsel wire has a shape of a quadrilateral, wherein in the cross section thereof the tinsel wire includes: a first plurality of the element wires, each having a large diameter, arranged in the middle of the cross section of the tinsel wire; and a second plurality of the element wires, each having a small diameter, arranged around the first element wires.

7. The tinsel wire according to claim 6, wherein the quadrilateral is a square, rectangle or rhombus.

8. The tinsel wire according to claim 6, wherein a length of one side of the cross section of the tinsel wire is equal to or longer than 70% of a length of another side of the cross section of the tinsel wire.

9. The tinsel wire according to claim 6, wherein the tinsel wire is coated with an electrically insulating coating, a cross section of which has a shape of a quadrilateral.

10. The tinsel wire according to claim 9, wherein the electrically insulating coating is made of synthetic resin, rubber, fibers dipped in resin or fibers dipped in rubber.

* * * * *